US005895698A

United States Patent [19]

Cacciatore et al.

[11] Patent Number: 5,895,698

[45] Date of Patent: Apr. 20, 1999

[54] PIZZA PLATFORM

[76] Inventors: Vincent Cacciatore; Patrice Cacciatore, both of 73 Staunton St., Yonkers, N.Y. 10704

[21] Appl. No.: 08/912,377

[22] Filed: Aug. 18, 1997

[51] Int. Cl.[6] ..... B65D 85/00

[52] U.S. Cl. ..... 206/525; 229/146; 229/906; 426/124

[58] Field of Search ..... 428/597, 596, 428/604, 66.6, 120, 180, 178; 99/DIG. 15, 450; 229/119, 165, 906, 146; 426/124; 206/525

[56] References Cited

U.S. PATENT DOCUMENTS

| | | | |
|---|---|---|---|
| 963,889 | 7/1910 | Goodwin | 428/180 |
| 3,042,532 | 7/1962 | Daline | 428/178 |
| 3,938,963 | 2/1976 | Hale | 428/596 |

*Primary Examiner*—Alexander Thomas

[57] ABSTRACT

A pizza platform is provided including a platform with a top face, a bottom face, and a periphery formed therebetween. The platform is constructed from metal. A plurality of small cones each have a base integrally coupled to the platform. As such, a pizza is placed atop the top face of the platform and the cones while being stored in a pizza box for preventing moisture from accumulating thereon.

1 Claim, 1 Drawing Sheet

14

PIZZA PLATFORM

BACKGROUND OF THE INVENTION

1. Field of the Invention

The present invention relates to a pizza platform and more particularly pertains to preventing moisture from accumulating on a bottom of a pizza.

2. Description of the Prior Art

The use of pizza boxes is known in the prior art. More specifically, pizza boxes heretofore devised and utilized for the purpose of storing pizza are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,883,196; U.S. Pat. No. 5,190,213; U.S. Pat. Des. No. 356,254; U.S. Pat. No. 4,537,313; U.S. Pat. No. 4,537,815; and U.S. Pat. No. 4,476,989.

In this respect, the pizza platform according to the present invention substantially departs from the conventional concepts and designs of the prior art, and in so doing provides an apparatus primarily developed for the purpose of preventing moisture from accumulating on a bottom of a pizza.

Therefore, it can be appreciated that there exists a continuing need for a new and improved pizza platform which can be used for preventing moisture from accumulating on a bottom of a pizza. In this regard, the present invention substantially fulfills this need.

SUMMARY OF THE INVENTION

In view of the foregoing disadvantages inherent in the known types of pizza boxes now present in the prior art, the present invention provides an improved pizza platform. As such, the general purpose of the present invention, which will be described subsequently in greater detail, is to provide a new and improved pizza platform which has all the advantages of the prior art and none of the disadvantages.

To attain this, the present invention essentially comprises a square platform with a top face, a bottom face, and a periphery formed therebetween. The platform is preferably constructed from aluminum. The square platform has a matrix of equally spaced circular apertures formed in an entire area thereof. Next provided is a plurality of small cones each having a base integrally coupled along a periphery of an associated one of the circular apertures of the platform, as shown in FIG. 4. As an option, an apex of each cone may be equipped with a small pin hole formed therein. Note FIG. 5. As such, the cones are adapted for allowing air to communicate between the top face and bottom face of the platform. By this structure, a pizza is placed atop the top face of the platform and the cones while being stored in a pizza box or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pizza platform which has all the advantages of the prior art pizza boxes and none of the disadvantages.

It is another object of the present invention to provide a new and improved pizza platform which may be easily and efficiently manufactured and marketed.

It is a further object of the present invention to provide a new and improved pizza platform which is of a durable and reliable construction.

An even further object of the present invention is to provide a new and improved pizza platform which is susceptible of a low cost of manufacture with regard to both materials and labor, and which accordingly is then susceptible of low prices of sale to the consuming public, thereby making such pizza platform economically available to the buying public.

Still yet another object of the present invention is to provide a new and improved pizza platform which provides in the apparatuses and methods of the prior art some of the advantages thereof, while simultaneously overcoming some of the disadvantages normally associated therewith.

Still another object of the present invention is to prevent moisture from accumulating on a bottom of a pizza.

Lastly, it is an object of the present invention to provide a new and improved pizza platform including a platform with a top face, a bottom face, and a periphery formed therebetween. The platform is constructed from metal. A plurality of small cones each have a base integrally coupled to the platform. As such, a pizza is placed atop the top face of the platform and the cones while being stored in a pizza box for preventing moisture from accumulating thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
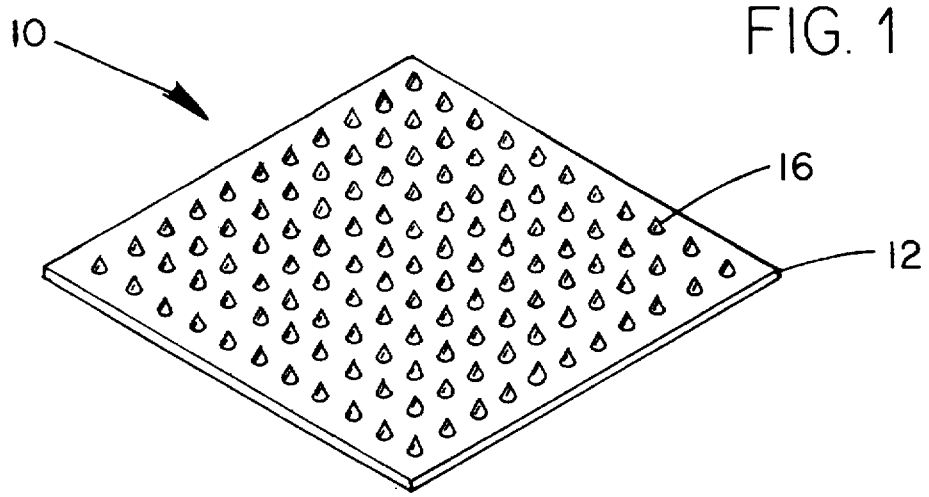
FIG. 1 is a perspective illustration of the preferred embodiment of the pizza platform constructed in accordance with the principles of the present invention.

With reference now to the drawings, and in particular to FIG. 1 thereof, a new and improved pizza platform embodying the principles and concepts of the present invention and generally designated by the reference numeral 10 will be described.

The present invention, the new and improved pizza platform, is comprised of a plurality of components. Such components in their broadest context include a platform and a plurality of cones. Such components are individually configured and correlated with respect to each other so as to attain the desired objective.

Figure 2:
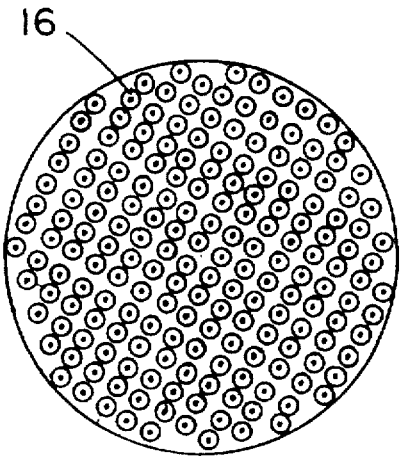
FIG. 2 is a top view of an alternate embodiment of the platform wherein it has a round configuration.
Figure 3:
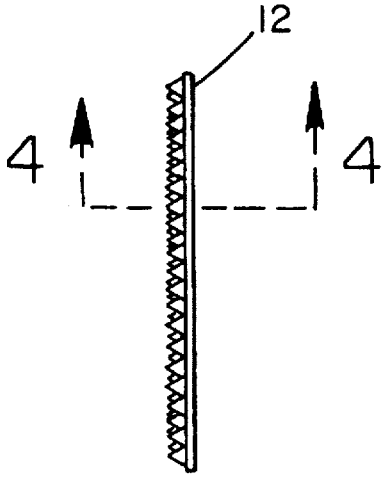
FIG. 3 is a side view of the present invention.

More specifically, it will be noted that the system 10 of the present invention includes a square planar platform 12 with a top face, a bottom face, and a periphery formed therebetween. In the alternative a platform of a circular configuration may be employed, as shown in FIG. 2. The platform is preferably constructed from aluminum or any other metal alloy. In an alternate embodiment, card board may be utilized to construct the platform, wherein the platform defines a bottom of a pizza box. The square platform has a matrix of equally spaced circular apertures 14 formed in an entire area thereof. Ideally, such spacing is minimal and of the order of a couple centimeters.

Figure 4:
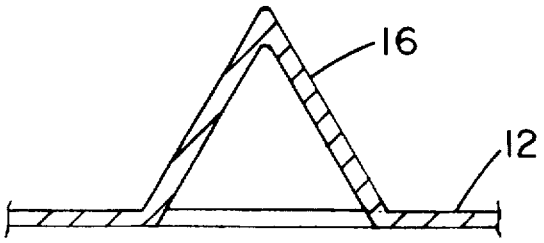
FIG. 4 is a cross-sectional view of one of the cones without the pin hole. Such view is taken along line 4—4 shown in FIG. 3.
Figure 5:
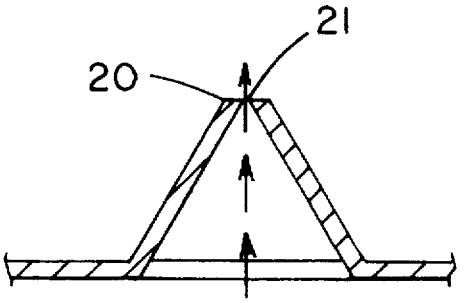
FIG. 5 is a cross-sectional view of one of the cones that is equipped with a pin hole.

Next provided is a plurality of small cones 16 each having a base 18 integrally coupled along a periphery of an associated one of the circular apertures of the platform, as shown in FIG. 4. A periphery of each cone ideally has constant thickness. As an option, an apex 20 of each cone may be equipped with a small pin hole 21 formed therein. Note FIG. 5. By this structure, a pizza is placed atop the top face of the platform and the cones. While not shown, the platform of the present invention is preferably situated on the bottom of a conventional pizza box Such pizza box is preferably similar to that shown and described in U.S. Pat. No. 5,190,213 which is incorporated herein by reference.

In use, the cones allow air to flow between the cones underneath the pizza crust and above the platform. Further, the cones with the pin holes are adapted for allowing air to communicate between the pizza and bottom face of the platform. Such air flow precludes the accumulation of moisture on the pizza crust and thus maintains the crust of the pizza crispy. It should be noted that the metal embodiment of the present invention may also be utilized for reheating the pizza in an oven.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pizza platform comprising, in combination:

a pizza box having a generally square configuration defined by an open upper end, a closed lower end upwardly extending side walls, and a top foldably coupled with an upper edge of one of the side walls for covering the open upper end:

a square platform with a top face, a bottom face, and a periphery formed therebetween, the platform constructed from aluminum, the square platform having a matrix of equally spaced circular apertures formed in an entire area thereof, the square platform being dimensioned for being received within the closed lower end of the pizza box; and a plurality of small cones each having a base integrally coupled along a periphery of an associated one of the circular apertures of the platform and extending upwardly therefrom, an apex of each cone having a small pin hole formed therein for allowing air to communicate between the top face and bottom face of the platform, whereby a pizza is placed atop the top face of the platform and the cones while being stored in the pizza box.

* * * * *